US011918053B2

(12) United States Patent
Rogan

(10) Patent No.: US 11,918,053 B2
(45) Date of Patent: Mar. 5, 2024

(54) METHOD AND APPARATUS FOR MANUFACTURING VAPOUR GENERATING PRODUCTS

(71) Applicant: JT International S.A., Geneva (CH)

(72) Inventor: Andrew Robert John Rogan, Forres (GB)

(73) Assignee: JT International S.A. (CH)

( * ) Notice: Subject to any disclaimer, the term of this patent is extended or adjusted under 35 U.S.C. 154(b) by 525 days.

(21) Appl. No.: 17/278,110

(22) PCT Filed: Nov. 25, 2019

(86) PCT No.: PCT/EP2019/082378
§ 371 (c)(1),
(2) Date: Mar. 19, 2021

(87) PCT Pub. No.: WO2020/109211
PCT Pub. Date: Jun. 4, 2020

(65) Prior Publication Data

US 2021/0345686 A1 Nov. 11, 2021

(30) Foreign Application Priority Data

Nov. 29, 2018 (EP) ..... 18209126
Nov. 29, 2018 (EP) ..... 18209147
Mar. 27, 2019 (EP) ..... 19165547

(51) Int. Cl.
*A24F 40/70* (2020.01)
*A24F 40/20* (2020.01)
*A24F 40/465* (2020.01)

(52) U.S. Cl.
CPC ..... *A24F 40/70* (2020.01); *A24F 40/20* (2020.01); *A24F 40/465* (2020.01)

(58) Field of Classification Search
CPC ..... A24F 40/70; A24F 40/20; A24F 40/465; A24C 5/01; A24C 5/1835; A24C 5/33;
(Continued)

(56) References Cited

U.S. PATENT DOCUMENTS 5,065,776 A * 11/1991 Lawson ..... A24D 1/02 131/194
5,271,419 A * 12/1993 Arzonico ..... A24D 3/043 131/365
(Continued)

FOREIGN PATENT DOCUMENTS

GB 2554141 A 3/2018
WO 2011122971 A2 10/2011
(Continued)

OTHER PUBLICATIONS

European Search Report for Application No. PCT/EP2019/082378, dated Mar. 16, 2020, 3 pages.
(Continued)

*Primary Examiner* — Truc T Nguyen
(74) *Attorney, Agent, or Firm* — Lerner David LLP

(57) ABSTRACT

A method of manufacturing a vapour generating product includes positioning non-liquid vapour generating material in a space defined by one or more walls configured to prevent movement of the vapour generating material by more than 2 mm in a direction perpendicular to an axial direction of the vapour generating material, the one or more walls extending substantially in the axial direction of the vapour generating material. The method further includes aligning an axis of a rigid insertor with the axial direction of the vapour generating material and inserting the rigid insertor into the vapour generating material from a first end of the vapour generating material. An apparatus for manufacturing a vapour generating product is also disclosed.

20 Claims, 11 Drawing Sheets

(58) Field of Classification Search
CPC ..... A24C 5/34; A24C 5/352; A24C 5/399; A24D 1/02; H05B 6/02; A24B 15/12
See application file for complete search history.

(56) References Cited

U.S. PATENT DOCUMENTS

| | | | | |
|---|---|---|---|---|
| 6,158,194 | A * | 12/2000 | Horn | A24C 5/352 53/236 |
| 10,645,972 | B2 * | 5/2020 | Batista | G01N 33/0036 |
| 2008/0092912 | A1 * | 4/2008 | Robinson | A24F 40/42 131/200 |
| 2017/0055582 | A1 | 3/2017 | Blandino et al. | |
| 2018/0228217 | A1 | 8/2018 | Mironov et al. | |
| 2018/0352855 | A1 | 12/2018 | Prestia et al. | |
| 2018/0360098 | A1 * | 12/2018 | Martel | A24C 5/01 |
| 2020/0060340 | A1 * | 2/2020 | Hejazi | A61M 11/042 |
| 2020/0107572 | A1 * | 4/2020 | Marques Borges | A24F 40/46 |
| 2020/0128880 | A1 * | 4/2020 | Gage | A24F 42/60 |
| 2020/0170298 | A1 * | 6/2020 | Lee | A24F 40/46 |
| 2023/0165301 | A1 * | 6/2023 | Batista | A24D 1/02 131/280 |

FOREIGN PATENT DOCUMENTS

| | | | |
|---|---|---|---|
| WO | 2015177294 | A1 | 11/2015 |
| WO | 2016184930 | A1 | 11/2016 |
| WO | 2017029270 | A1 | 2/2017 |
| WO | 2017072144 | A1 | 5/2017 |
| WO | 2018002084 | A1 | 1/2018 |

OTHER PUBLICATIONS

International Search Report for Application No. PCT/EP2019/062484 dated Sep. 11, 2019, 2 pages.
International Search Report including Written Opinion for PCT/EP2019/062496 dated Sep. 10, 2019; 13 pages.

* cited by examiner

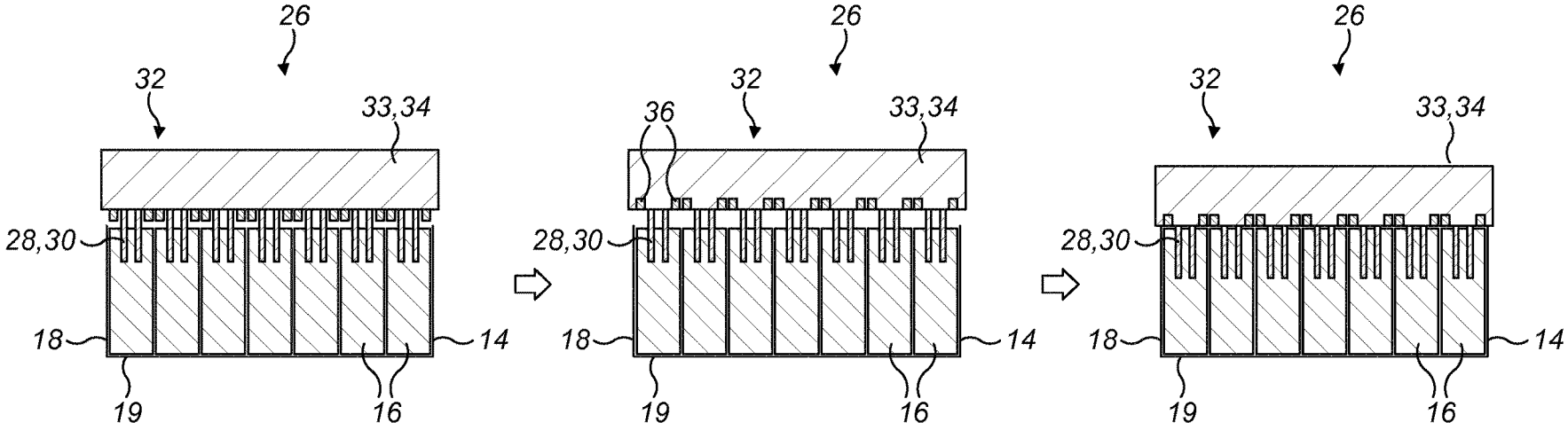
FIG. 2e
FIG. 2f
FIG. 2g
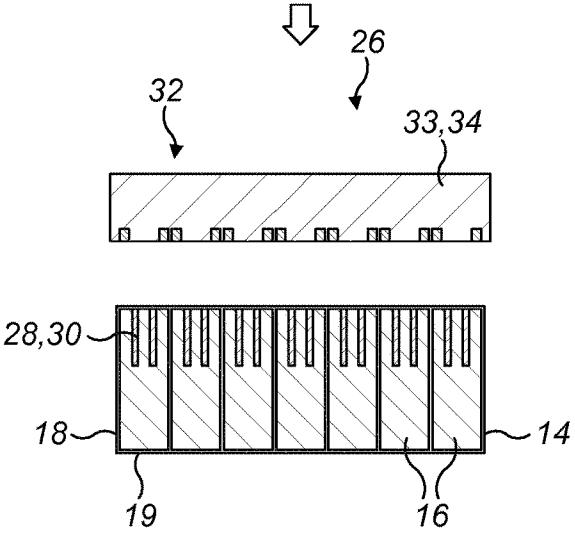
FIG. 2h

METHOD AND APPARATUS FOR MANUFACTURING VAPOUR GENERATING PRODUCTS

CROSS-REFERENCE TO RELATED APPLICATIONS

The present application is a national phase entry under 35 U.S.C. § 371 of International Application No. PCT/EP2019/082378, filed Nov. 25, 2019, published in English, which claims priority to European Application No. 18209126.4 filed Nov. 29, 2018, European Application No. 18209147.0 filed Nov. 29, 2018, and European Application No. 19165547.1 filed Mar. 27, 2019, the disclosures of which are incorporated herein by reference.

TECHNICAL FIELD

The present disclosure relates generally to vapour generating products, and more particularly to vapour generating products for use with a vapour generating device for heating the vapour generating products to generate a vapour that cools and condenses to form an aerosol for inhalation by a user. Embodiments of the present disclosure relate in particular to methods of, and apparatus for, manufacturing a vapour generating product.

TECHNICAL BACKGROUND

Devices which heat, rather than burn, a vapour generating material to produce a vapour which cools and condenses to form an aerosol for inhalation have become popular with consumers in recent years.

Such devices can use one of a number of different approaches to provide heat to the vapour generating material.

One approach is to provide a vapour generating device which employs a resistive heating system. In such a device, a resistive heating element is provided to heat the vapour generating material and vapour is generated as the vapour generating material is heated by heat transferred from the heating element.

Another approach is to provide a vapour generating device which employs an induction heating system. In such a device, an induction coil is provided with the device and a susceptor is provided typically with the vapour generating material. Electrical energy is supplied to the induction coil when a user activates the device which in turn generates an alternating electromagnetic field. The susceptor couples with the electromagnetic field and generates heat which is transferred, for example by conduction, to the vapour generating material and vapour is generated as the vapour generating material is heated.

Whichever approach is used to heat the vapour generating material, it can be convenient to provide the vapour generating material in the form of a vapour generating product which can be inserted by a user into a vapour generating device. As such, there is a need to provide methods and apparatus which facilitate the manufacture of vapour generating products.

SUMMARY OF THE DISCLOSURE

According to a first aspect of the present disclosure, there is provided a method of manufacturing a vapour generating product, the method comprising:

(i) positioning non-liquid vapour generating material in a space defined by one or more walls configured to prevent movement of the vapour generating material by more than 2 mm in a direction perpendicular to an axial direction of the vapour generating material, the one or more walls extending substantially in the axial direction of the vapour generating material;

(ii) aligning an axis of a rigid insertor with the axial direction of the vapour generating material; and (iii) inserting the rigid insertor into the vapour generating material from a first end of the vapour generating material.

According to a second aspect of the present disclosure, there is provided an apparatus for manufacturing a vapour generating product, the apparatus comprising:

a surrounding unit configured to surround non-liquid vapour generating material;

a holding unit configured to hold a rigid insertor; and a moving unit configured to move the non-liquid vapour generating material surrounded by the surrounding unit and the rigid insertor held by the holding unit relative to each other substantially in line with the axial direction of the vapour generating material to insert the rigid insertor into the vapour generating material from a first end of the vapour generating material;

wherein the surrounding unit comprises one or more walls defining a space for the vapour generating material, the one or more walls being configured to prevent movement of the vapour generating material by more than 2 mm in a direction perpendicular to an axial direction of the vapour generating material.

As used herein, the phrase "substantially in the axial direction" encompasses arrangements in which the one or more walls extend in the axial direction of the vapour generating material within a tolerance which may be ±5°, possibly ±3°, or possibly ±1°.

The vapour generating product is for use with a vapour generating device for heating the non-liquid vapour generating material, without burning the non-liquid vapour generating material, to volatise at least one component of the non-liquid vapour generating material and thereby generate a heated vapour which cools and condenses to form an aerosol for inhalation by a user of the vapour generating device.

In general terms, a vapour is a substance in the gas phase at a temperature lower than its critical temperature, which means that the vapour can be condensed to a liquid by increasing its pressure without reducing the temperature, whereas an aerosol is a suspension of fine solid particles or liquid droplets, in air or another gas. It should, however, be noted that the terms 'aerosol' and 'vapour' may be used interchangeably in this specification, particularly with regard to the form of the inhalable medium that is generated for inhalation by a user.

Vapour generating products according to the present disclosure can be manufactured efficiently, and mass produced with relative ease, by moving the non-liquid vapour generating material and the rigid insertor relative to each other to insert the rigid insertor into the non-liquid vapour generating material. The provision of one or more walls configured to constrain the movement of the non-liquid vapour generating material, and more particularly to prevent its movement by more than 2 mm, in a direction perpendicular to the axial direction of the vapour generating material ensures that the rigid insertor is reliably inserted into the vapour generating material.

The rigid insertor is sufficiently rigid along said axis to allow the rigid insertor to be reliably inserted, for example by pushing, into the non-liquid vapour generating material during step (iii).

Step (iii) may comprise, and hence the relative movement between the non-liquid vapour generating material and the rigid insertor may be achieved by, moving only the non-liquid vapour generating material towards the rigid insertor, by moving only the rigid insertor towards the non-liquid vapour generating material, or by moving both the non-liquid vapour generating material and the rigid insertor towards each other. The method and apparatus can, therefore, be adapted to meet particular manufacturing requirements.

The non-liquid vapour generating material may comprise a vapour generating rod and, in some embodiments, may comprise a plurality of said vapour generating rods. Thus, step (i) may comprise forming a package comprising a plurality of the vapour generating rods. The manufacture of vapour generating products according to the present disclosure may be streamlined by eliminating the need for a separate packaging process. The vapour generating rod(s) could, for example, have a substantially circular cross-section and, thus, the vapour generating material may be in the form of a cylindrical rod. The vapour generating rod(s) may alternatively have an oval, rectangular or polygonal cross-section.

The space defined by the one or more walls may be configured to accommodate between 1 and 60 vapour generating rods. In some embodiments, the space defined by the one or more walls may be configured to accommodate between 10 and 40 vapour generating rods, and possibly between 15 and 30 vapour generating rods.

The non-liquid vapour generating material, for example the vapour generating rod(s), may be wrapped by a sheet of material which may be air-permeable and which may be electrically insulating and non-magnetic, for example a paper wrapper.

The non-liquid vapour generating material may be any type of solid or semi-solid material. Example types of vapour generating material include powder, granules, particles, gel, strips, loose leaves, cut filler, pellets, powder, shreds, strands, foam material and sheets. In embodiments in which the non-liquid vapour generating material is not wrapped by a sheet of material such as a paper wrapper, the non-liquid vapour generating rod may advantageously comprise a foam material.

The non-liquid vapour generating material may comprise plant derived material and in particular, may comprise tobacco. The non-liquid vapour generating material may, for example, comprise reconstituted tobacco including tobacco and any one or more of cellulose fibres, tobacco stalk fibres and inorganic fillers such as $CaCO_3$. The non-liquid vapour generating material may comprise extruded strips and may, for example, comprise an extruded vapour generating material such as tobacco or reconstituted tobacco.

The non-liquid vapour generating material may comprise an aerosol-former. Examples of aerosol-formers include polyhydric alcohols and mixtures thereof such as glycerine or propylene glycol. Typically, the non-liquid vapour generating material may comprise an aerosol-former content of between approximately 5% and approximately 50% on a dry weight basis. In some embodiments, the non-liquid vapour generating material may comprise an aerosol-former content of between approximately 10% and approximately 20% on a dry weight basis, and possibly approximately 15% on a dry weight basis.

The one or more walls may be configured to prevent movement of the vapour generating material by more than 1 mm in a direction perpendicular to the axial direction of the vapour generating material. The one or more walls may be configured to prevent substantially any movement of the vapour generating material in a direction perpendicular to the axial direction of the vapour generating material.

Step (i) may comprise contacting a surface of the non-liquid vapour generating material by the one or more walls to prevent said movement of the vapour generating material by more than 2 mm in a direction perpendicular to the axial direction of the vapour generating material. With this arrangement, any movement of the vapour generating material is substantially prevented due to the contact with the one or more walls.

Step (i) may comprise applying suction through one or more apertures in the one or more walls to prevent said movement of the vapour generating material by more than 2 mm in a direction perpendicular to the axial direction of the vapour generating material.

The space may be defined by a box comprising a plurality of walls. A box may provide a particularly convenient enclosure for the non-liquid vapour generating material to prevent its movement by more than 2 mm in a direction perpendicular to the axial direction of the vapour generating material, especially in embodiments in which the vapour generating material positioned in the space comprises a plurality of vapour generating rods.

The one or more walls may comprise one or more selected from the group consisting of planar wall elements, rod-shaped wall elements or pin-shaped wall elements which may be in point contact with the vapour generating material.

One or more of the walls may be movable between a first position to allow positioning of the non-liquid vapour generating material in the space and a second position to prevent release of the non-liquid vapour generating material from the space. Thus, step (i), and optionally step (ii), may comprise moving at least one of the walls to surround the vapour generating material. The method may further comprise releasing the vapour generating material from the space defined by the one or more walls, for example by moving one or more of the walls from the second position towards the first position.

Step (i) may comprise moving at least one of the walls to a predetermined position, for example the second position, to prevent said movement of the vapour generating material. The non-liquid vapour generating material, for example the one or more vapour generating rods, may also be moved to a predetermined position by virtue of the movement of the at least one of the walls to the predetermined position, for example the second position, and the resulting movement of the non-liquid vapour generating material may align the axis of the rigid insertor with the axial direction of the vapour generating material. Thus, step (ii) may also comprise moving at least one of the walls to the predetermined position.

Step (i) may comprise moving at least one of the walls along a guide to the predetermined position. The guide may be aligned in a direction that is substantially orthogonal to the axial direction of the non-liquid vapour generating material. Reliable and repeatable movement of the at least one of the walls is, therefore, assured.

In embodiments in which the non-liquid vapour generating material comprises a vapour generating rod, step (i) may comprise moving at least one of the walls in a radial direction relative to the vapour generating rod, for example to the predetermined position.

The rigid insertor may comprise an inductively heatable susceptor. The inductively heatable susceptor may comprise one or more, but not limited, of aluminium, iron, nickel, stainless steel and alloys thereof, e.g. Nickel Chromium or Nickel Copper. With the application of an electromagnetic field in its vicinity, for example when the vapour generating product is positioned in a vapour generating device having an induction coil for generating an alternating electromagnetic field, the inductively heatable susceptor may generate heat due to eddy currents and magnetic hysteresis losses resulting in a conversion of energy from electromagnetic to heat for heating the vapour generating material without burning it.

The rigid insertor may comprise a flavourant, for example for releasing one or more flavour compounds during use of the vapour generating product in a vapour generating device. The rigid insertor could comprise a porous material impregnated with a flavourant.

The rigid insertor may be configured to provide a plurality of fluid flow routes in the axial direction of the vapour generating material, for example to allow air and/or vapour to flow in the axial direction. The provision of separate fluid flow routes maintains the quality of the generated vapour even if the separated vapour generating material within each fluid flow route is heated separately, because the vapour generated by heating the separated vapour generating material within each fluid flow route does not flow through previously heated vapour generating material which might adversely affect the characteristics of the vapour, for example leading to an off-taste.

Step (i) may comprise positioning the non-liquid vapour generating material in the space defined by the one or more walls by moving the vapour generating material in a direction substantially parallel to an axial direction of the vapour generating material.

In embodiments in which the vapour generating material comprises one or more vapour generating rods, step (i) may comprise positioning the vapour generating rod(s) in the space defined by the one or more walls by moving the vapour generating rod(s) in a direction substantially parallel to an axial direction of the vapour generating rod(s).

Step (i) may comprise positioning the non-liquid vapour generating material in the space defined by the one or more walls by moving the vapour generating material in a direction that is non-parallel to an axial direction of the vapour generating material. In embodiments in which the vapour generating material comprises one or more vapour generating rods, step (i) may comprise positioning the vapour generating rod(s) in the space defined by the one or more walls by moving the vapour generating rod(s) in a direction that is non-parallel to an axial direction of the vapour generating rod(s).

Step (ii) may be performed by detecting the position of one or both of the rigid insertor and the vapour generating material, for example the one or more vapour generating rods. One or more detecting units (e.g. image capture devices such as cameras, optical sensors or magnetic sensors) may be used to detect the position of one or both of the rigid insertor and the vapour generating material. Step (ii) may comprise moving one or both of the rigid insertor and the vapour generating material based on the detected position(s). Correct alignment of the rigid insertor and the vapour generating material is, therefore, assured, thereby ensuring that the rigid insertor can be reliably inserted into the vapour generating material.

The method may further comprise supporting a second end of the vapour generating material during step (iii) to prevent movement of the vapour generating material. This ensures that the rigid insertor can be reliably inserted into the vapour generating material from the first end because movement of the vapour generating material by the external force applied by the rigid insertor is substantially prevented.

Step (iii) may comprise inserting the rigid insertor into the vapour generating material substantially in line with the direction of gravity.

Step (iii) may comprise simultaneously inserting a plurality of rigid insertors into the vapour generating material.

Step (iii) may comprise the steps of:

partially inserting the rigid insertor into the vapour generating material from the first end whilst holding the rigid insertor; and releasing the rigid insertor and pushing an end of the rigid insertor to fully insert the rigid insertor into the vapour generating material.

The rigid insertor can, therefore, be reliably and fully inserted into the vapour generating material from the first end.

Step (iii) may comprise pushing and embedding the rigid insertor into the vapour generating material, and preferably during said embedding step a surface of the vapour generating material into which the rigid insertor is inserted is not pushed. In this embodiment, the rigid insertor works very well especially if the rigid insertor interacts with the vapour generating material since the rigid insertor is completely surrounded by the vapour generating material. This is particularly advantageous when the rigid insertor comprises an inductively heatable susceptor because heat transfer from the susceptor to the surrounding vapour generating material is maximised. It will be also understood that the vapour generating material is pushed only in the area where the rigid insertor is inserted, and that a surface of the vapour generating material other than this area is not pushed. Unwanted deformation of the vapour generating material can, therefore, be avoided whilst at the same time ensuring reliable insertion of the rigid insertor into the vapour generating material.

The holding unit may include a contact element to contact a side of the rigid insertor. The contact element ensures that the rigid insertor is securely held by the holding unit.

The moving unit may include a pushing element to push an end of the rigid insertor. The pushing element ensures that the rigid insertor is reliably inserted into the vapour generating material, for example whilst being held by the contact element.

The pushing element may include a contact area having a shape which may correspond to the shape of an end of the rigid insertor or part of the shape of an end of the rigid insertor. This arrangement ensures that there is good contact between the pushing element and the end of the rigid insertor, thereby ensuring reliable insertion of the rigid insertor into the vapour generating material by the pushing element. In addition, this arrangement can embed the rigid insertor into the vapour generating material.

The surrounding unit may include a movable wall. As noted above, the movable wall may be movable between a first position to allow positioning of the non-liquid vapour generating material in the space and a second position to prevent release of the non-liquid vapour generating material from the space. The provision of a movable wall facilitates positioning of the vapour generating material in the space when the movable wall is in the first position and ensures that the vapour generating material is securely retained in the space when the movable wall is in the second position. The movable wall may, for example, be configured to retain the vapour generating material in a predetermined position when the movable wall is in the second position.

The apparatus may include a detecting unit to detect the position of one or both of the rigid insertor and the vapour generating material, for example the one or more vapour generating rods. The detecting unit may comprise one or more image capture devices, for example one or more cameras, optical sensors or magnetic sensors. The apparatus may further comprise a second moving unit for moving one or both of the rigid insertor and the vapour generating material based on the detected position(s). As noted above, correct alignment of the rigid insertor and the vapour generating material is, therefore, assured, thereby ensuring that the rigid insertor can be reliably inserted into the vapour generating material.

The surrounding unit may include a continuous transfer belt. The use of a continuous transfer belt may facilitate mass production of vapour generating products.

The continuous transfer belt may include spaced contact elements which may be configured to contact the vapour generating material and which may form regions therebetween configured to accommodate the vapour generating material. By way of example, the spaced contact elements may have a triangular cross-section, an isosceles trapezoid cross-section, or a generally T-shaped cross-section optionally having stepped surfaces. Each of the spaced contact elements may have one or more points of contact with the vapour generating material accommodated in the regions between the spaced contact elements or may have curved contact surfaces which conform generally to the shape of the vapour generating material to contact the vapour generating material. The spacing between the spaced contact elements also means that it is difficult for unexpected undesirable debris or factory dust to build up on the continuous transfer belt.

The surrounding unit may include two continuous transfer belts, for example a first transfer belt and a second transfer belt. Each continuous transfer belt may include spaced contact elements which may be configured to contact the vapour generating material and which may form regions therebetween configured to accommodate the vapour generating material. Each of the spaced contact elements may have a summit and the summits of the spaced contact elements of each transfer belt may be arranged to face each other. The first transfer belt may be positioned in use beneath the second transfer belt. Thus, the first transfer belt may be a lower belt and the second transfer belt may be an upper belt.

The apparatus may comprise a hopper for continuously and sequentially supplying vapour generating material, for example vapour generating rods, to the regions formed between the spaced contact elements of the or each transfer belt. The hopper may be positioned above the transfer belt, and may be positioned above the first transfer belt. This arrangement further facilitates mass production of vapour generating products.

The holding unit may be configured to move synchronously with the or each continuous transfer belt. The holding unit may be positioned adjacent to the or each continuous transfer belt and may be configured to move continuously and synchronously with the or each continuous transfer belt. With this arrangement, the holding unit follows the movement of the or each transfer belt, ensuring that the rigid insertor can be reliably inserted into the vapour generating material and allowing mass production of vapour generating products.

The holding unit may comprise a plurality of pushing elements mounted on a continuous belt. The pushing elements may be aligned with the regions formed between the spaced contact elements and may be configured to move synchronously with the or each continuous transfer belt. The pushing elements may be configured to move towards, and thereafter away from, vapour generating material, for example vapour generating rods, accommodated in the regions formed between the spaced contact elements when the pushing elements are aligned with the regions formed between the spaced contact elements. Reliable insertion of the rigid insertors into the vapour generating material is thereby assured.

The pushing elements may be configured to receive rigid insertors when the pushing elements are not aligned with the regions formed between the spaced contact elements. Accordingly, rigid insertors can be easily supplied to the pushing elements that constitute the holding unit.

BRIEF DESCRIPTION OF THE DRAWINGS

FIGS. 2*a* to 2*h* are diagrammatic illustrations of part of one example of an apparatus and method for manufacturing a vapour generating product illustrating the insertion of rigid insertors into vapour generating rods;

FIGS. 3*a* and 3*b* are diagrammatic illustrations of a first example of an apparatus and method for detecting and aligning the positions of the rigid insertors and the vapour generating rods, wherein FIG. 3*b* shows partial views in the direction of arrow B in FIG. 3*a* before and after alignment;

FIGS. 4*a* to 4*c* are diagrammatic illustrations of a second example of an apparatus and method for detecting and aligning the positions of the rigid insertors and the vapour generating rods, wherein FIG. 4*c* shows partial views in the direction of arrow C in FIG. 4*b* before and after alignment;

DETAILED DESCRIPTION OF EMBODIMENTS

Embodiments of the present disclosure will now be described by way of example only and with reference to the accompanying drawings.

Figures 1A, 1B, 1C:
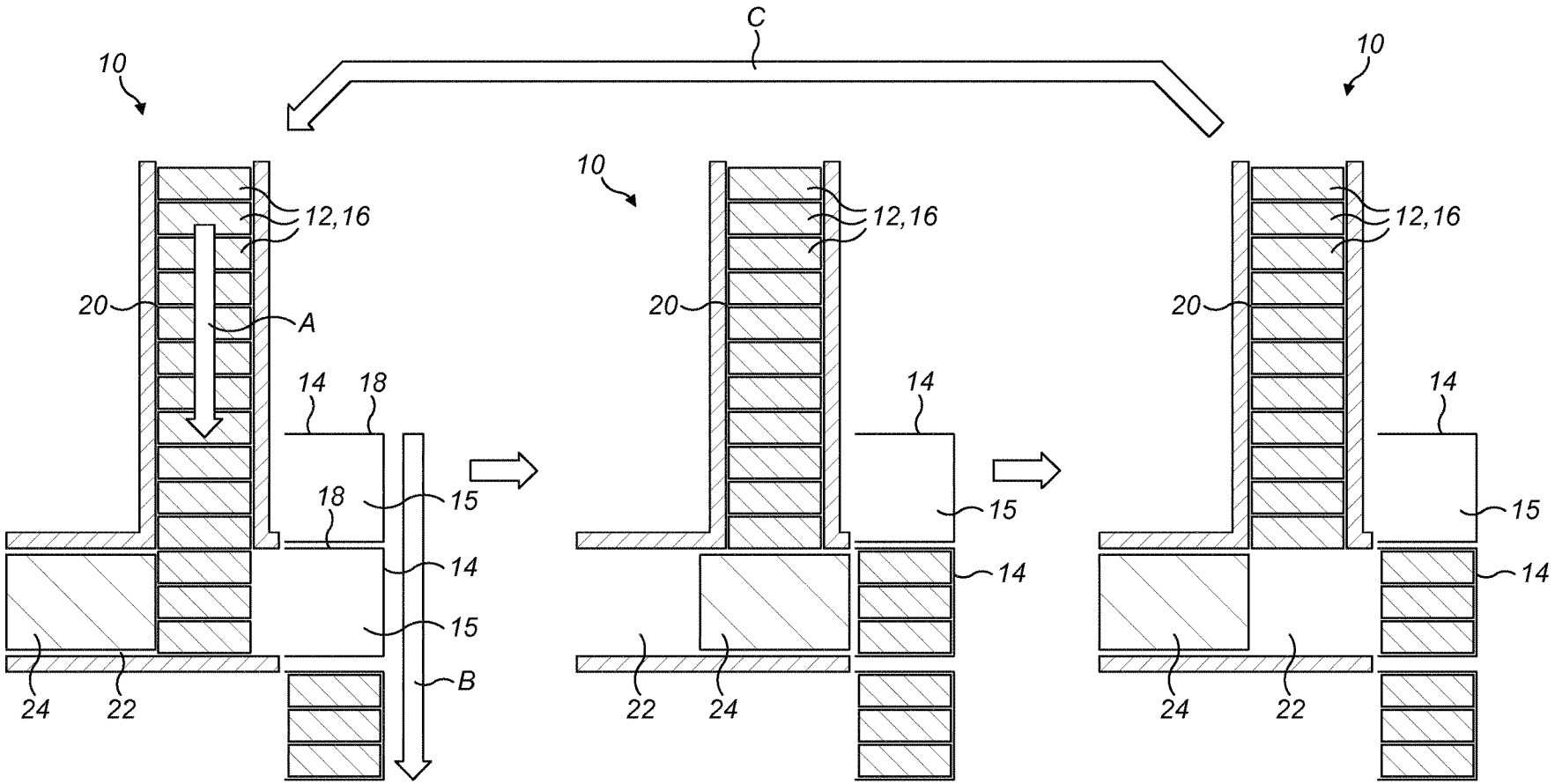
FIGS. 1*a* to 1*c* are diagrammatic illustrations of part of one example of an apparatus and method for manufacturing a vapour generating product illustrating the positioning of vapour generating rods in a surrounding unit.

Referring initially to FIGS. 1*a* to 1*c*, there is shown an example of a method and apparatus 10 for positioning non-liquid vapour generating material 12 in a surrounding unit 14. In this example, the non-liquid vapour generating material 12 comprises a plurality of vapour generating rods 16, typically comprising plant derived material such as tobacco or reconstituted tobacco, and the surrounding unit 14 comprises a plurality of walls 18 defining a space 15 in which the vapour generating rods 16 are locatable. In the illustrated example, the surrounding unit 14 comprises a box.

The apparatus 10 includes a vertical channel 20 in which a continuous supply of the vapour generating rods 16 is received, e.g., from an upstream manufacturing process. The apparatus 10 also includes a horizontal transfer channel 22 positioned beneath the vertical channel 20 and a transfer element 24 that is mounted for reciprocating (i.e. back and forth) movement in the horizontal transfer channel 22 between a start position shown in FIGS. 1*a* and 1*c* and an end position shown in FIG. 1*b*.

In operation of the apparatus 10, the vapour generating rods 16 in the vertical channel 20 sequentially fall into the horizontal transfer channel 22 under the action of gravity, as denoted by arrow A. In the illustrated example, the vapour generating rods 16 and the horizontal transfer channel 22 are dimensioned so that three vertically stacked vapour generating rods 16 are accommodated in the horizontal transfer channel 22 at any one time. It will, however, be understood by one of ordinary skill in the art that the diameter of the vapour generating rods 16 and/or the depth of the horizontal transfer channel 22 could be increased or decreased to accommodate more or less than three vertically stacked vapour generating rods 16 in the horizontal transfer channel 22 at any one time.

Referring to FIGS. 1*a* and 1*b*, the transfer element 24 moves from the start position shown in FIG. 1*a* to the end position shown in FIG. 1*b* to push the array of vapour generating rods 16 accommodated in the horizontal transfer channel 22 into the space 15 defined by the walls 18 of an empty surrounding unit 14 that is vertically aligned with an open end of the horizontal transfer channel 22. The transfer element 24 is then moved from the end position shown in FIG. 1*b* back to the start position shown in FIG. 1*c*, thereby allowing further vapour generating rods 16 to fall under the action of gravity into the horizontal transfer channel 22. The filled surrounding unit 14 containing the vapour generating rods 16 is also moved, for example in a vertically downward direction (arrow B in FIG. 1*a*), and a further empty surrounding unit 14 is then vertically aligned with the open end of the horizontal transfer channel 22 before the steps described above are repeated continuously (as denoted by arrow C) to position arrays of the vapour generating rods 16 in multiple surrounding units 14.

It will be understood by one of ordinary skill in the art that the vapour generating rods 16 may be arranged in the vertical channel 20, and hence in the horizontal transfer channel 22, as a plurality of vertical columns arranged in a side-by-side configuration, so that the vapour generating rods 16 are arranged in adjacent vertical columns as well as being stacked on top of each other. Thus, an array (e.g. 3×3, 3×4, etc) of vapour generating rods 16 can be accommodated in the horizontal transfer channel 22 and pushed into the empty surrounding unit 14 by the transfer element 24 so that an array of vapour generating rods 16 is positioned in the surrounding unit 14, for example as shown in FIG. 2*a*.

Figure 2A:
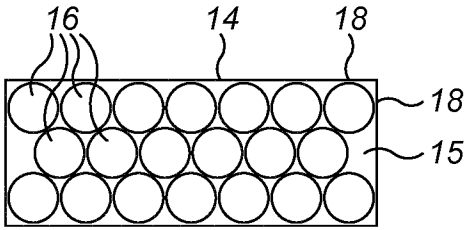
Figure 2B:
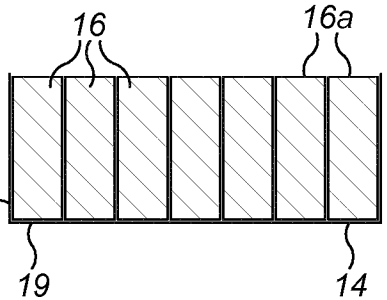

FIGS. 2*a* and 2*b* illustrate an array of vapour generating rods 16 positioned in the space 15 defined by the walls 18 of a surrounding unit 14 using the method and apparatus 10 described above with reference to FIGS. 1*a* to 1*c*. It will be apparent from FIGS. 1*a* to 1*c* and FIG. 2*a* that the walls 18 of the surrounding unit 14 extend substantially in the axial direction of the vapour generating rods 16. Furthermore, the walls 18 are configured to prevent movement of the vapour generating rods 16 by more than 2 mm in a direction that is perpendicular to the axial direction of the vapour generating rods 16, for example by virtue of contact between the outermost vapour generating rods 16 of the array and the walls 18.

FIGS. 2*c* to 2*h* illustrate a method and apparatus 26 for inserting a rigid insertor 28 into each of the vapour generating rods 16 to form a plurality of vapour generating products 1. Each rigid insertor 28 is sufficiently rigid in the axial direction (i.e. along its longitudinal axis) to enable the rigid insertor 28 to be inserted into the vapour generating rods 16 from a first end 16*a* of the vapour generating rods 16 without buckling or bending. In one example, the rigid insertor 28 comprises an inductively heatable susceptor 30 which is inductively heated in the presence of an electromagnetic field when a vapour generating product 1 comprising the vapour generating rod 16 and the inductively heatable susceptor 30 is positioned in a vapour generating device (not shown). The principle of operation of an inductively heatable vapour generating device will be understood by one of ordinary skill in the art and will not be explained further in this specification.

Figure 2C:
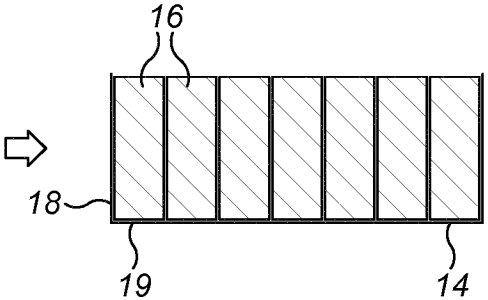

Referring to FIGS. 2*c* to 2*h*, the apparatus 26 comprises a holding unit 32 that is configured to hold an array of the rigid insertors 28 and a moving unit 33 in the form of a pushing element 34 that is arranged to push an end of each rigid insertor 28 to insert it into a corresponding one of the vapour generating rods 16. The holding unit 32 comprises a plurality of contact elements 36 movable between a holding position shown in FIGS. 2*c* to 2*d* and a non-holding position shown in FIGS. 2*e* to 2*h*. When the contact elements 36 are in the holding position, each contact element 36 contacts a side of a corresponding rigid insertor 28 as best seen in FIG. 2*c* to align an axis of each rigid insertor 28 with the axial direction of a corresponding one of the vapour generating rods 16.

Figure 2D:
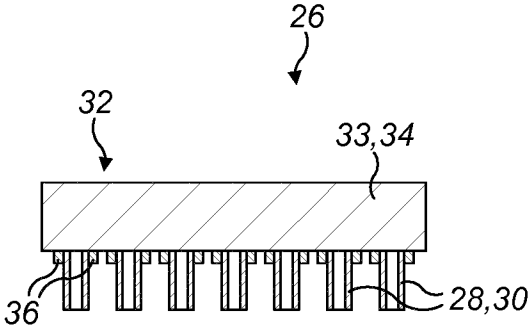
Figure 2D:
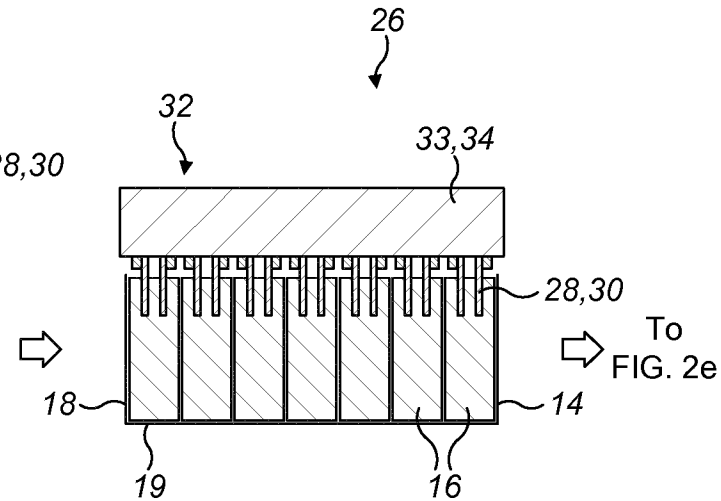

The pushing element 34 is moved towards the array of vapour generating rods 16 as shown in FIG. 2*d* to simultaneously insert the array of rigid insertors 28 into the vapour generating rods 16 from the first end 16*a* of the vapour generating rods 16. The holding unit 32 includes a base wall 19 to support a second end 16*b* of the vapour generating rods 16 during insertion of the array of rigid insertors 28 and to thereby prevent movement of the vapour generating rods 16 due to the external force applied by the rigid insertors 28. When the rigid insertors 28 have been partially inserted as shown in FIG. 2*d*, the contact elements 36 are moved initially in a sideways direction as shown in FIG. 2*e* so that they no longer contact the side of the rigid insertors 28 before the contact elements 36 are then moved from the holding position shown in FIG. 2*e* to the non-holding position shown in FIG. 2*f*. Continued movement of the pushing element 34 towards the array of vapour generating rods 16 as shown in FIG. 2*g* completes the insertion of the array of rigid insertors 28 into the vapour generating rods 16 and ensures that the rigid insertors 28 are fully inserted into in the vapour generating rods 16 to thereby form an array of vapour generating products 1, each comprising a vapour generating rod 16 and a rigid insertor 28. The pushing element 34 can then be moved away from the array of vapour generating rods 16 as shown in FIG. 2*h* before the contact elements 36 are moved back to the holding position and the steps illustrated in FIGS. 2*c* to 2*h* are repeated to continuously manufacture further arrays of vapour generating products 1.

Figure 3A:
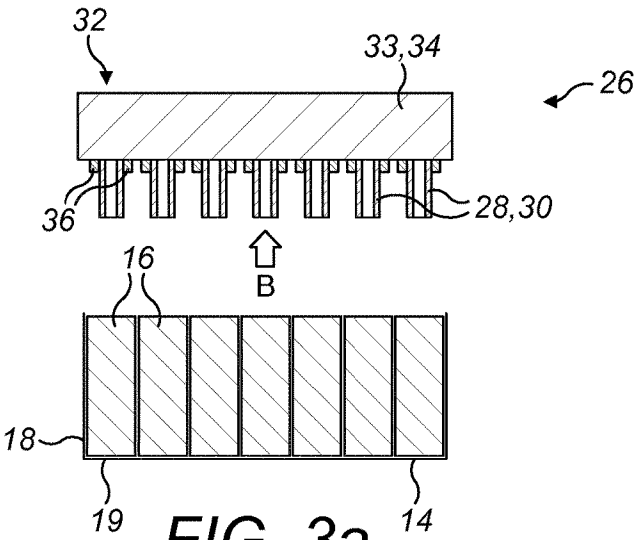
Figure 3B:
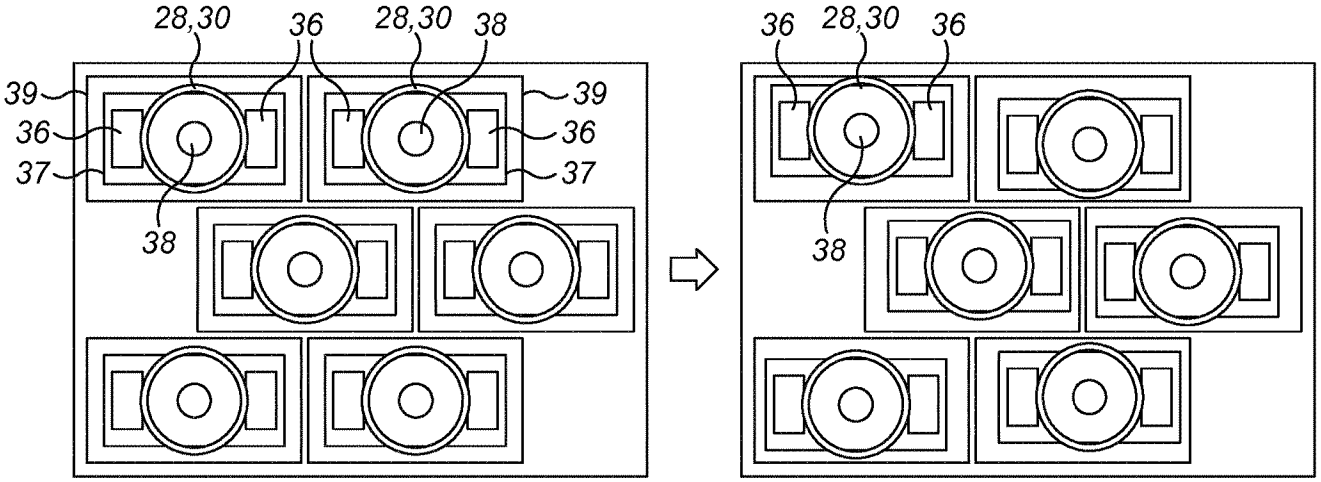

Referring to FIGS. 3*a* and 3*b*, in one embodiment the apparatus 26 includes an array of detecting units 38, for example cameras, mounted on the holding unit 32. Each of the detecting units 38 is configured to detect the position of a corresponding one of the vapour generating rods 16 in the space 15 defined by the walls 18 of the surrounding unit 14 and the apparatus 26 comprises a plurality of second moving units 37 for moving the rigid insertors 28 based on the detected position(s) of the vapour generating rods 16 to align the rigid insertors 28 with the vapour generating rods 16 in the direction of insertion. For example, it can be seen from the right-hand view in FIG. 3*b* that at least some of the rigid insertors 28 have been moved by the second moving units 37 (which are movable within the envelope defined by the boundary 39) to ensure that the rigid insertors 28 are optimally aligned with the corresponding vapour generating rods 16.

Figure 4B:
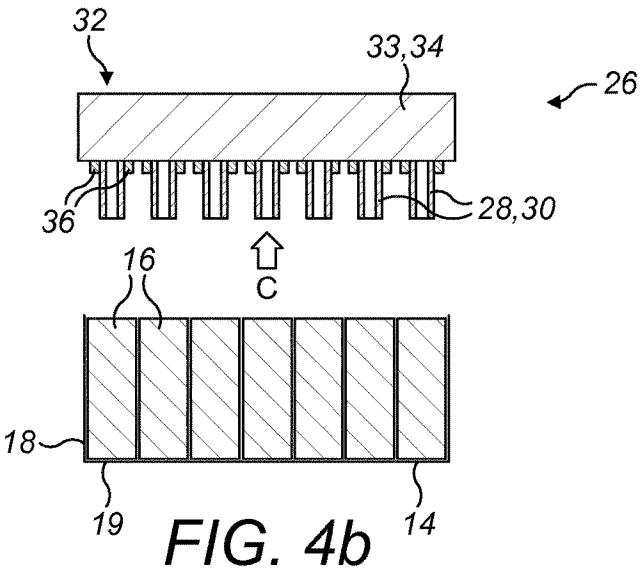
Figure 4A:
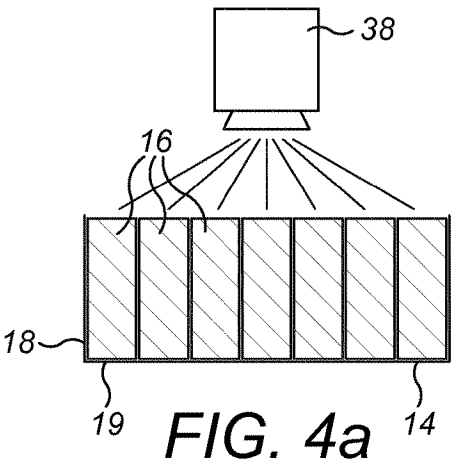
Figure 4C:
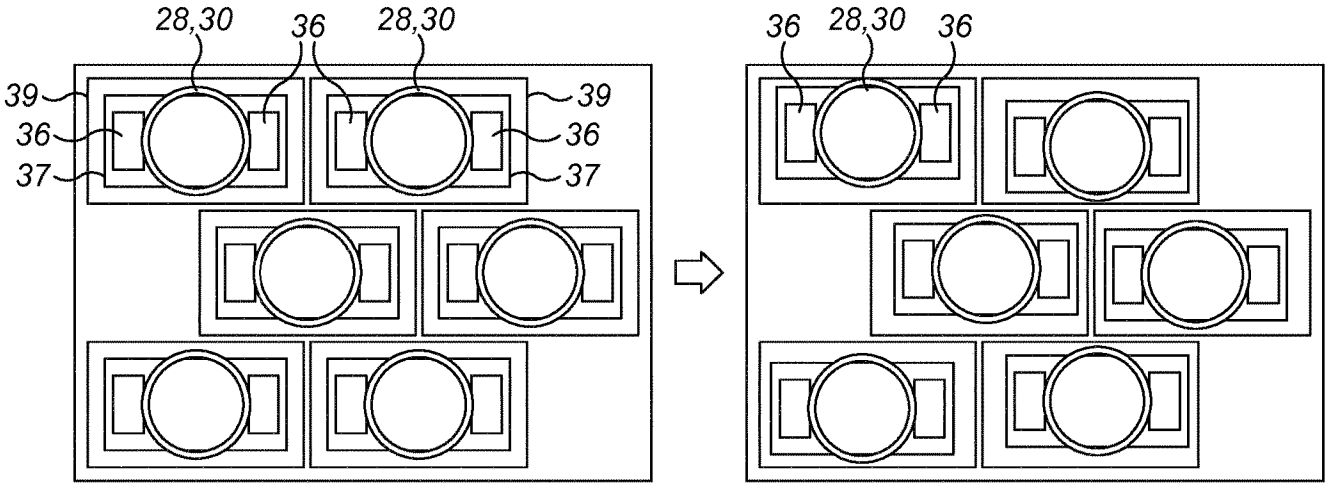

Referring to FIGS. 4*a* to 4*c*, in another embodiment the apparatus 26 includes one detecting unit 38, for example a camera. The detecting unit 38 is configured to simultaneously detect the positions of all of the vapour generating rods 16 in the space 15 defined by the walls 18 of the surrounding unit 14 as shown diagrammatically in FIG. 4*a*. After the positions of the vapour generating rods 16 have been detected by the camera 38, the second moving units 37 can be operated as necessary to move one or more of the rigid insertors 28 to align the rigid insertors 28 with the vapour generating rods 16 in the direction of insertion. For example, it can be seen from the right-hand view in FIG. 4*c* that at least some of the rigid insertors 28 have been moved by the second moving units 37 (which are movable within the envelope defined by the boundary 39) to ensure that the rigid insertors 28 are optimally aligned with the corresponding vapour generating rods 16. Finally, the holding unit 32 as shown in FIG. 4*b* can be moved towards the vapour generating rods 16 to insert the aligned rigid insertors 28 into the vapour generating rods 16 as described above with reference to FIGS. 2*c* to 2*h*.

Referring now to FIGS. 5*a* to 5*e*, there is shown a further example of a method and apparatus 40 for inserting a rigid insertor 28 into a vapour generating rod 16 to form a vapour generating product 1. The method and apparatus 40 are similar to the method and apparatus 26 described above with reference to FIGS. 2*a* to 2*h* and corresponding elements are, therefore, designated using the same reference numerals.

In this example, the holding unit 32 includes a projecting element 42 defining a contact area 44 which corresponds to the shape of an end of the rigid insertor 28. In the illustrated example, the rigid insertor has circular cross-section and consequently the projecting element 42 is generally ring-shaped and defines a ring-shaped contact area 44.

Figures 5A, 5B, 5C, 5D, 5E:
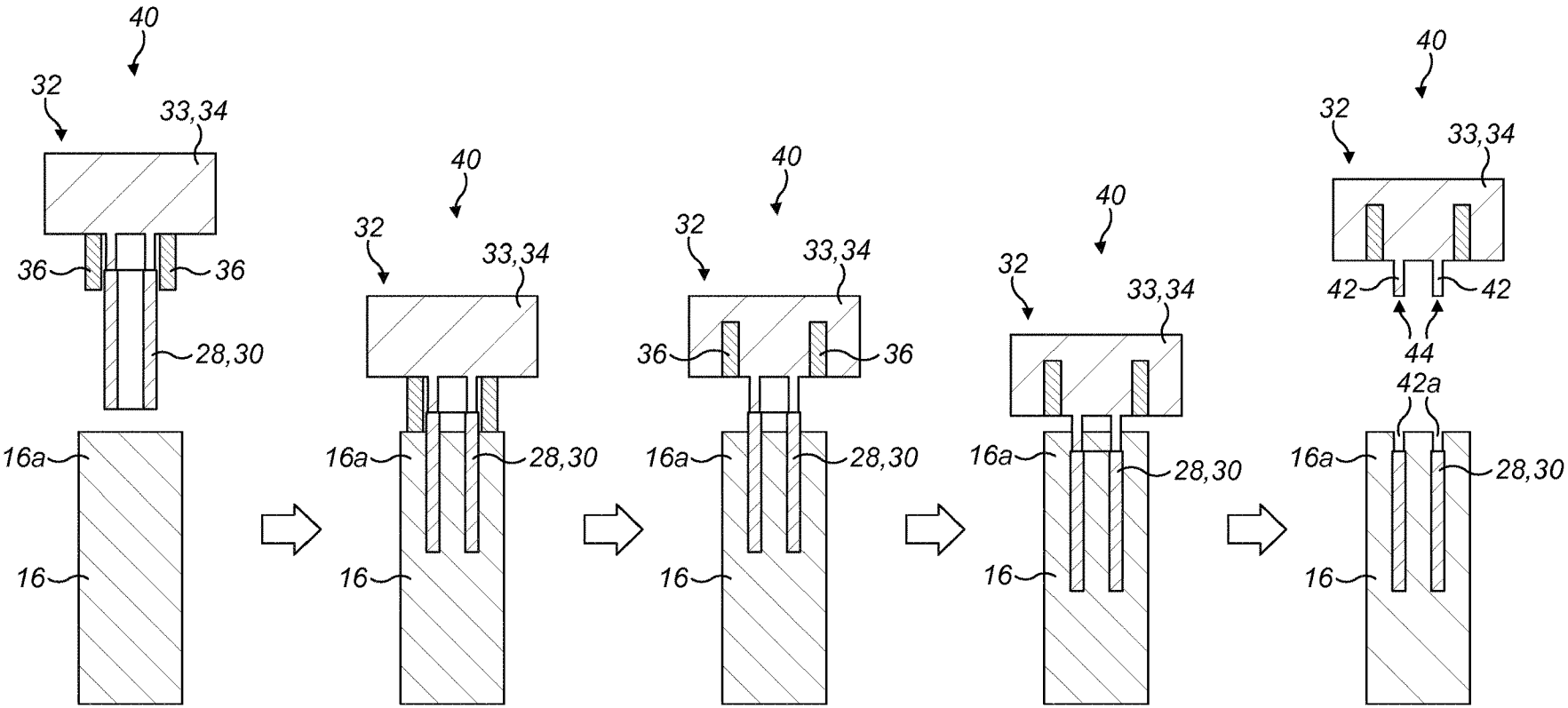
FIGS. 5*a* to 5*e* are diagrammatic illustrations of an example of a holding unit and a moving unit which is configured to move a rigid insertor towards a vapour generating rod.

With the contact elements 36 initially in the holding position as shown in FIG. 5*a*, the rigid insertor 28 is held by the holding unit 32 and aligned with the axial direction of the vapour generating rod 16. The pushing element 34 is moved towards the vapour generating rod 16 as shown in FIG. 5*b* to insert the rigid insertor 28 into the vapour generating rod 16 from the first end 16*a* of the vapour generating rod 16. When the rigid insertor 28 has been partially inserted as shown in FIG. 5*c*, the contact elements 36 are moved initially in a sideways direction so that they no longer contact the side of the rigid insertor 28 before the contact elements 36 are then moved from the holding position shown in FIG. 5*b* to the non-holding position shown in FIG. 5*c*. Continued movement of the pushing element 34 towards the vapour generating rod 16 as shown in FIG. 5*d* completes the insertion of the rigid insertor 28 into the vapour generating rod 16. In this example, the projecting element 42 is pushed into the vapour generating rod 16 to ensure that the rigid insertor 28 is fully embedded in the vapour generating rod 16. The pushing element 34 is then moved away from the vapour generating rod 16 as shown in FIG. 5*e* before the contact elements 36 are moved back to the holding position and the steps illustrated in FIGS. 5*a* to 5*e* are repeated to continuously manufacture further vapour generating products 1.

It should be noted that the size of the spaces 42*a* in the first end 16*a* of the vapour generating rod 16 created by the projecting elements 42 is exaggerated for illustration purposes. In practice, the spaces 42*a* can be extremely small, for example in the case where the projecting elements 42 are pin-shaped elements having a small cross-sectional area. Furthermore, the vapour generating material 12 of the vapour generating rod 16 may spontaneously fill the spaces 42*a* (partially or fully) after the pushing element 34 has been moved away from the vapour generating rod 16 as shown in FIG. 5*e* due to the inherent elasticity of the vapour generating material 12. This may typically be the case in embodiments in which the vapour generating material 12 comprises tobacco cut filler.

Referring now to FIGS. 6*a* to 6*d*, there is shown a further example of a method and apparatus 46 for inserting a rigid insertor 28 into a vapour generating rod 16 to form a vapour generating product 1.

In this example, the rigid insertor 28 is again held by a holding unit 32. The holding unit 32 includes a contact element 36 which is movable between a holding position shown in FIGS. 6*a* and 6*b* and a non-holding position shown in FIGS. 6*c* and 6*d*. When the contact element 36 is in the holding position, it extends into the opening at the end of the rigid insertor 28 to support it on the holding unit 32.

The apparatus 46 includes a moving unit 48 having a support member 50 which supports a second end 16*b* of the vapour generating rod 16. In the illustrated example, the support member 50 comprises a collar which surrounds the second end 16*b*, although it will be understood by one of ordinary skill in the art that the support member 50 may have any suitable form.

In this example, the moving unit 48 is moved towards the holding unit 32 to insert the rigid insertor 28 into the vapour generating rod 16 from the first end of the vapour generating rod 16. Thus, the vapour generating rod 16 is moved by the moving unit 48 whilst the rigid insertor 28 remains stationary and supported by the holding unit 32.

Figures 6A, 6B, 6C, 6D:
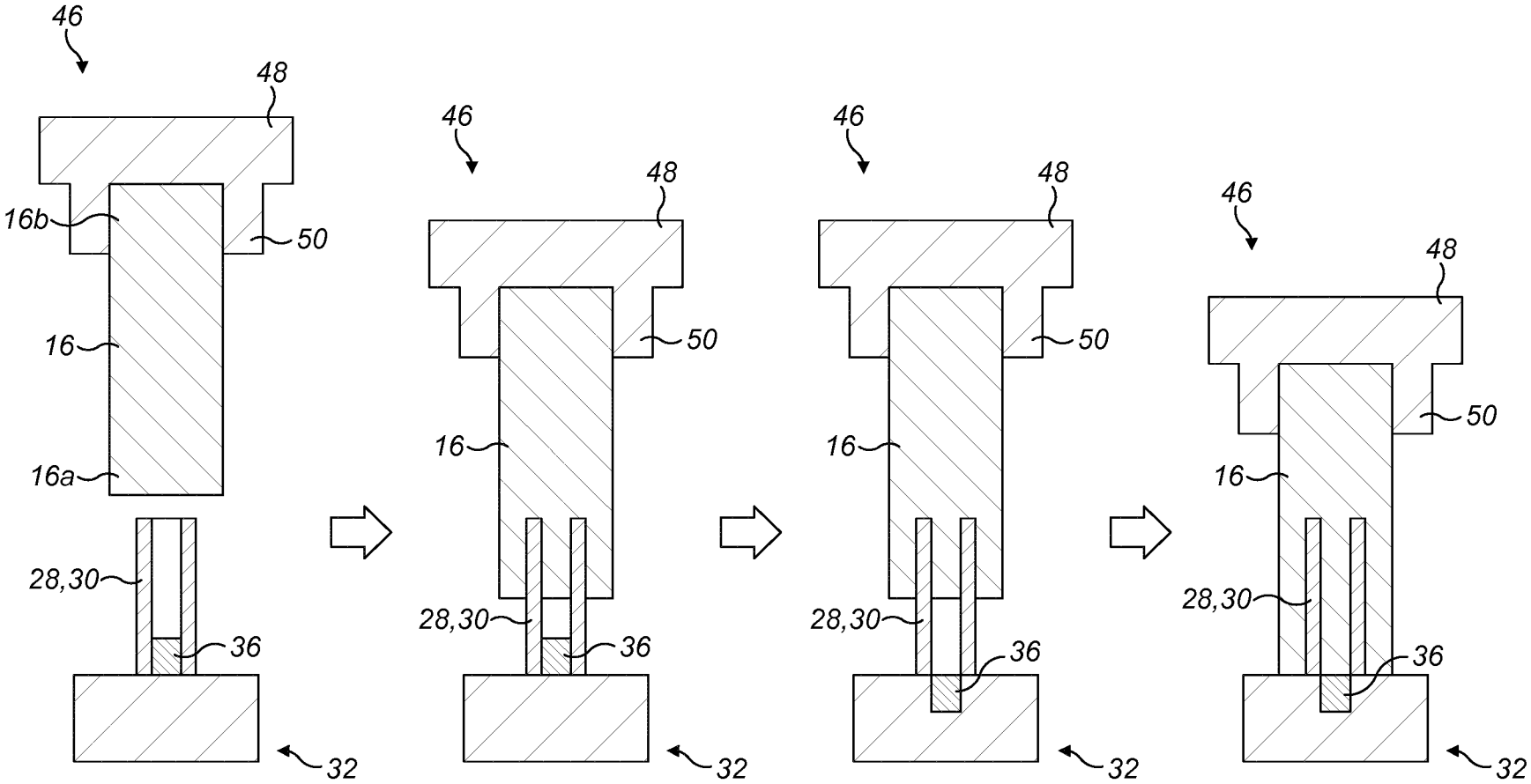
FIGS. 6*a* to 6*d* are diagrammatic illustrations of an example of a holding unit and a moving unit which is configured to move a vapour generating rod towards a rigid insertor.

When the rigid insertor 28 has been partially inserted into the vapour generating rod 16 as shown in FIG. 6*b*, the contact element 36 is moved from the holding position shown in FIG. 6*b* to the non-holding position shown in FIG. 6*c*. Continued movement of the vapour generating rod 16 towards the holding unit 32 as shown in FIG. 6*d* completes the insertion of the rigid insertor 28 into the vapour generating rod 16 to form a vapour generating product 1 and the steps illustrated in FIGS. 6*a* to 6*d* are thereafter repeated to continuously manufacture further vapour generating products 1.

Figure 7A:
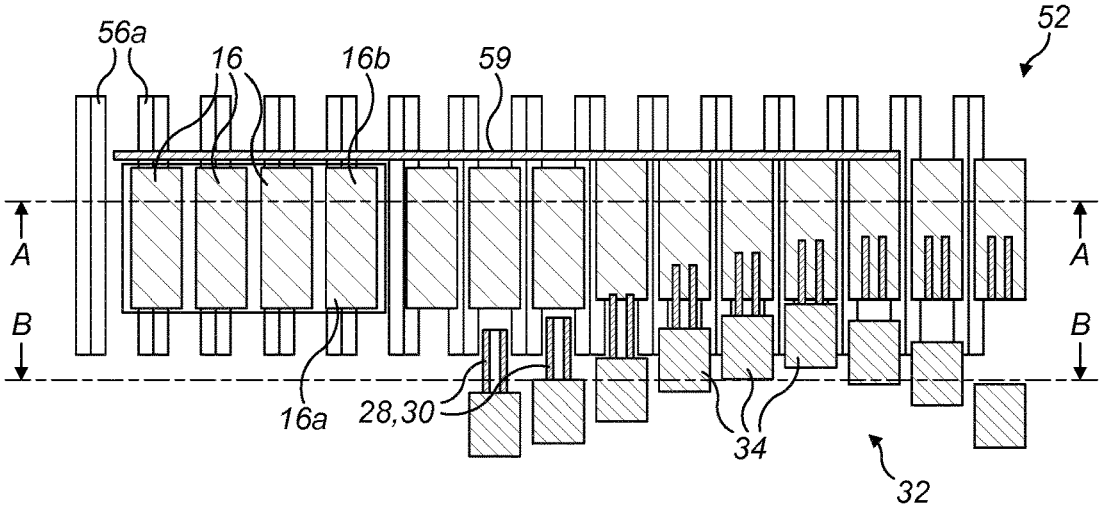
FIG. 7*a* is a diagrammatic plan view of another example of an apparatus and method for manufacturing a vapour generating product.
Figure 7B:
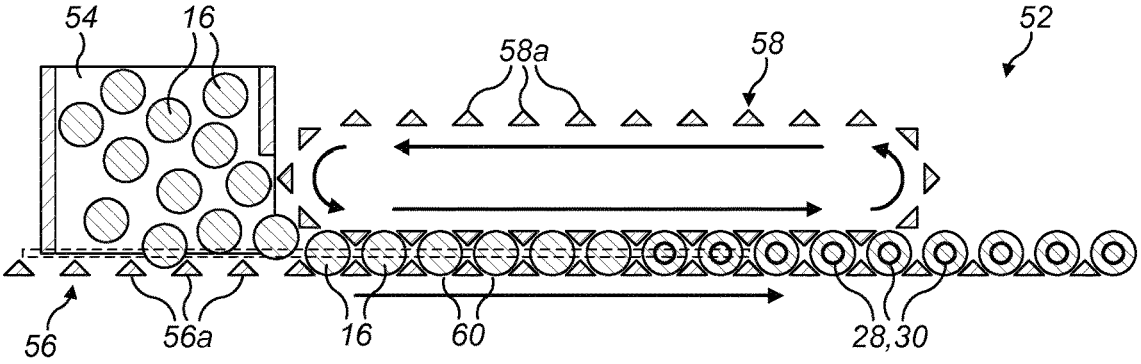
FIG. 7*b* is a diagrammatic cross-sectional view along the line A-A in FIG. 7*a;*
Figure 7C:
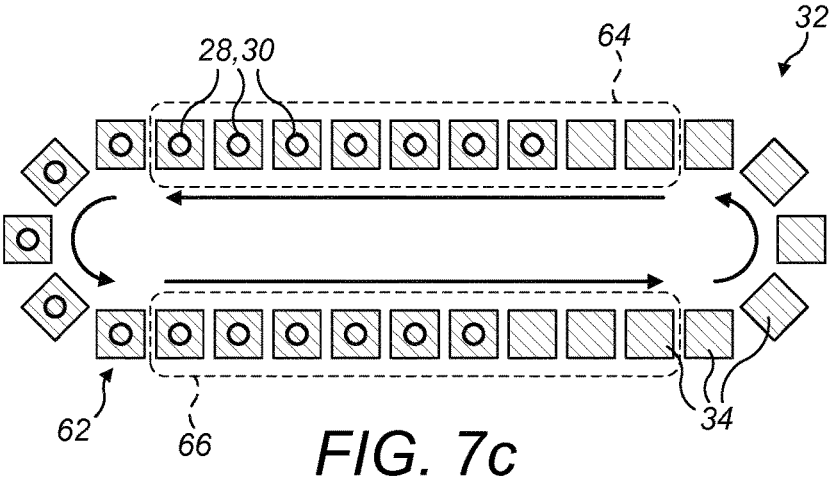
FIG. 7*c* is a diagrammatic cross-sectional view along the line B-B in FIG. 7*a;*

Referring now to FIGS. 7*a* to 7*c*, there is shown an example of a method and apparatus 52 for continuously manufacturing vapour generating products 1. The apparatus 52 comprises a hopper 54 containing a plurality of vapour generating rods 16 and first and second transfer belts 56, 58 which together constitute a surrounding unit 14. The first and second transfer belts 56, 58 are continuous (i.e. endless) belts, although it will be noted that only part of the first transfer belt 56 is shown in FIGS. 7*a* to 7*c*. The hopper is positioned above the first transfer belt 56 to supply vapour generating rods 16 to the first transfer belt 56.

Each of the first and second transfer belts 56, 58 comprises a plurality of spaced contact elements 56*a*, 58*a* which are generally triangular in cross-section and which form regions 60 therebetween that accommodate individual vapour generating rods 16 supplied by the hopper 54 to the first transfer belt 56. Each of the triangular contact elements 56*a*, 58*a* has a summit and the summits of the contact elements 56*a*, 58*a* on each of the first and second transfer belts 56, 58 are arranged to face each other so that the vapour generating rods 16 are accommodated securely in the regions 60 between the contact elements 56*a*, 58*a*.

The apparatus 52 further includes a holding unit 32 which is positioned adjacent to the first and second transfer belts 56, 58 and which is configured to move continuously and synchronously with the first and second transfer belts 56, 58. The holding unit 32 comprises a plurality of individual pushing elements 34 which are mounted on a continuous (i.e. endless) belt 62 as shown in FIG. 7*c*. The pushing elements 34 are aligned with the regions 60 formed between the spaced contact elements 56*a*, 58*a* of the first and second transfer belts 56, 58 and move synchronously with the first and second transfer belts 56, 58. When the pushing elements 34 are in a first region 64 on the continuous belt 62, rigid insertors 28 are supplied to each of the pushing elements 34 as shown in FIG. 7*c*. When the pushing elements 34 are in a second region 66 on the continuous belt 62, the pushing elements 32 are moved towards, and thereafter away from, the vapour generating rods 16 as shown in FIG. 7*a* to insert the rigid insertors 28 into the vapour generating rods 16 from the first end 16*a* to form vapour generating products 1 which are subsequently released from the first and second transfer belts 56, 58. It will be seen in FIG. 7*a* that the apparatus 52 includes a support member 59 to support the second ends 16*b* of the vapour generating rods 16 and thereby prevent sideways movement of the vapour generating rods 16 in the regions 60 between the spaced contact elements 56*a*, 58*a* during insertion of the rigid insertors 28 into the vapour generating rods 16 from the first end 16*a*.

Referring now to FIGS. 8*a* to 8*g*, examples of possible arrangements of vapour generating rods 16 and surrounding units 14 are shown.

Figure 8A:
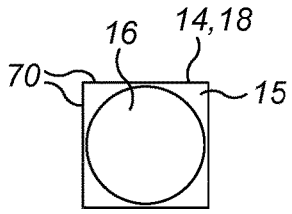
FIGS. 8*a* to 8*g* are examples of possible arrangements of vapour generating rods and surrounding units.

In FIG. 8*a*, a single vapour generating rod 16 is accommodated in a surrounding unit 14 comprising a plurality of walls 18 in the form of planar wall elements 70. The vapour generating rod 16 may contact one or more of the planar wall elements 70 to prevent movement of the vapour generating rod 16 by more than 2 mm in a direction perpendicular to the axial direction of the vapour generating rod 16.

Figure 8B:
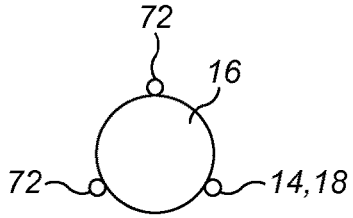
Figure 8C:
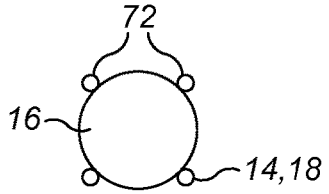

In FIGS. 8*b* and 8*c*, a single vapour generating rod 16 is accommodated in a surrounding unit 14 comprising a plurality of walls 18 in the form of rod-shaped or pin-shaped wall elements 72. The rod-shaped or pin-shaped wall elements 72 are in point contact with the vapour generating rod 16 to prevent movement of the vapour generating rod 16 by more than 2 mm in a direction perpendicular to the axial direction of the vapour generating rod 16.

Figure 8D:
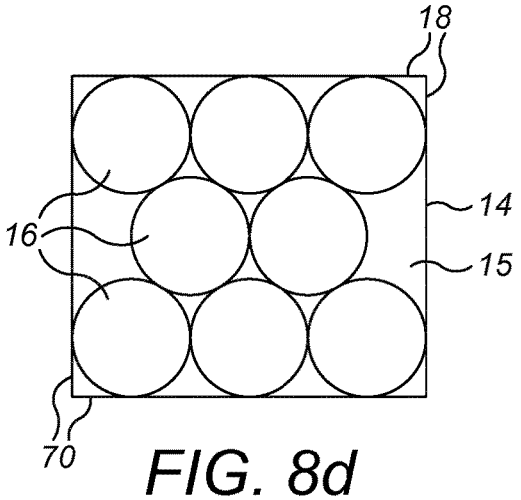
Figure 8E:
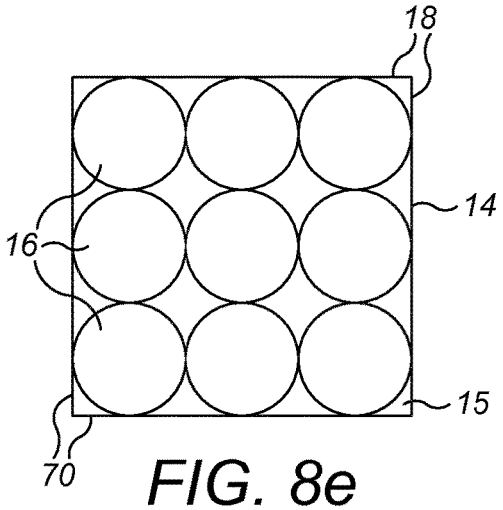

In FIGS. 8*d* and 8*e*, a plurality of vapour generating rods 16 is accommodated in a surrounding unit 14 comprising a plurality of walls 18 in the form of planar wall elements 70. The vapour generating rods 16 are arranged side-by-side and stacked on top of each other to form an array of the vapour generating rods 16, albeit that the arrays shown in FIGS. 8*d* and 8*e* have different configurations. The outermost vapour generating rods 16 in the array may contact one or more of the planar wall elements 70 to prevent movement of the vapour generating rods 16 by more than 2 mm in a direction perpendicular to the axial direction of the vapour generating rods 16.

Figure 8F:
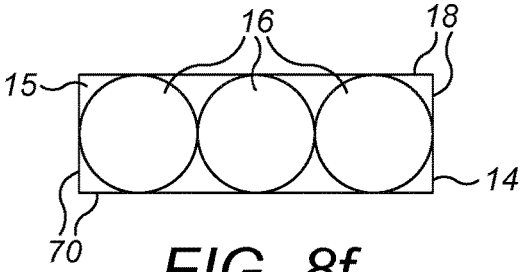

FIG. 8*f* also illustrates a plurality of vapour generating rods 16 in the form of an array and accommodated in a surrounding unit 14 comprising a plurality of walls 18 in the form of planar wall elements 70. The vapour generating rods 16 are arranged side-by-side to form a single-layer array in which the vapour generating rods 16 may contact one or more of the planar wall elements 70 to prevent movement of the vapour generating rods 16 by more than 2 mm in a direction perpendicular to the axial direction of the vapour generating rods 16.

Figure 8G:
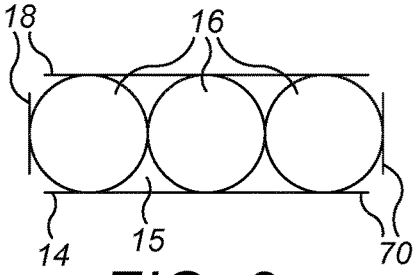

FIG. 8*g* illustrates an arrangement of vapour generating rods similar to that shown in FIG. 8*f*, but in which the surrounding unit 14 comprises a plurality of discontinuous planar wall elements 70.

In some embodiments, one or more of the walls 18 forming the surrounding unit 14 may be movable, as will now be described in further detail with reference to FIGS. 9*a* to 9*h*.

Figure 9D:
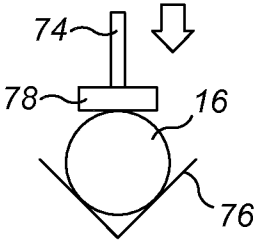
FIGS. 9*a* to 9*h* are illustrative examples showing possible movement of one or more walls of a surrounding unit.
Figure 9C:
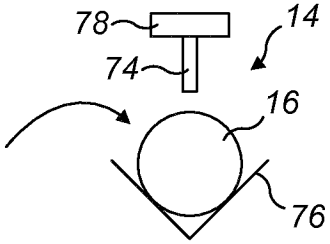
Figure 9B:
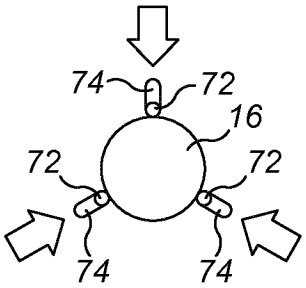
Figure 9A:
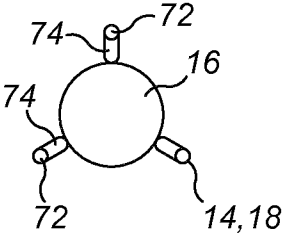

FIGS. 9*a* and 9*b* show an arrangement similar to FIG. 8*b* in which a single vapour generating rod 16 is accommodated in a surrounding unit 14 comprising a plurality of walls 18 in the form of rod-shaped or pin-shaped wall elements 72. Each of the rod-shaped r pin-shaped wall elements 72 is movable along a guide 74 aligned in a direction that is substantially orthogonal to the axial direction of the vapour generating rod 16 between a first position shown in FIG. 9*a*, which allows the vapour generating rod 16 to be inserted in its axial direction into the space 15 defined by the wall elements 72, and a second position shown in FIG. 9*b* in which the wall elements 72 are in point contact with the vapour generating rod 16 to prevent its movement by more than 2 mm in a direction perpendicular to the axial direction of the vapour generating rod 16.

FIGS. 9*c* and 9*d* show an arrangement in which a single vapour generating rod is accommodated in a surrounding unit 14 comprising a v-shaped wall 76 and a sliding wall 78 that is movable along a guide 74 aligned in a direction that is substantially orthogonal to the axial direction of the vapour generating rod 16 between a first position shown in FIG. 9*c* and a second position shown in FIG. 9*d*. When the sliding wall 78 is in the first position, a vapour generating rod 16 can be positioned in the space 15 defined by the walls 76, 78, for example in a sideways direction as shown by the arrow in FIG. 9*c*. Thereafter, the sliding wall 78 can be moved along the guide 74 to the second position shown in FIG. 9*d* to ensure that the walls 76, 78 are in contact with the vapour generating rod 16 and to thereby prevent movement of the vapour generating rod 16 by more than 2 mm in a direction perpendicular to its axial direction.

Figure 9E:
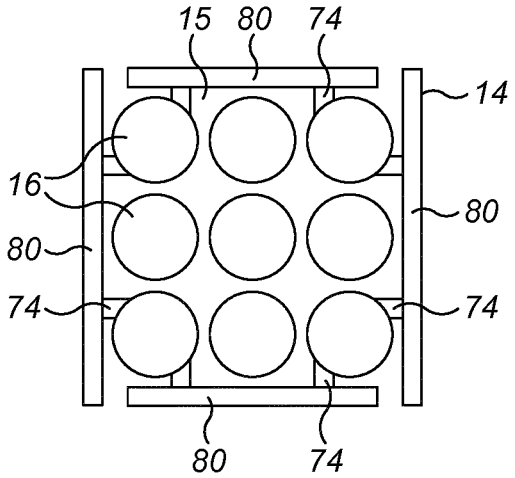
Figure 9F:
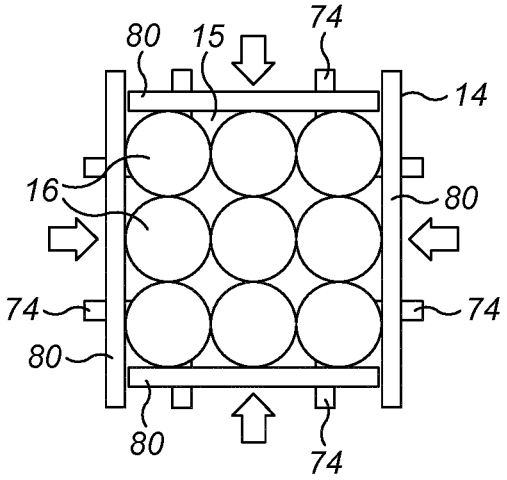

FIGS. 9*e* and 9*f* show an arrangement in which a plurality of vapour generating rods 16 is accommodated in a surrounding unit 14 comprising a plurality of movable walls 80 that are movable along corresponding guides 74 each of which is aligned in a direction substantially orthogonal to the axial direction of the vapour generating rods 16. The vapour generating rods 16 form an array in which the vapour generating rods 16 are arranged side-by-side and the vapour generating rods 16 are inserted in their axial direction into the space 15 defined by the movable walls 80. Each of the walls 80 is movable between a first position shown in FIG. 9*e* and a second position shown in FIG. 9*f*. When the walls 80 are in the first position, the vapour generating rods 16 can be inserted into the space 15 defined by the walls 80 so that they are loosely arranged in the space 15. Thereafter the walls 80 are moved to the second position as shown by the arrows in FIG. 9*f*. The movement of the walls 80 from the first position to the second position moves the vapour generating rods 16 to a predetermined position in which they are in contact with each other and in which the outermost vapour generating rods 16 in the array are in contact with the walls 80 to prevent movement of the vapour generating rods 16 by more than 2 mm in a direction perpendicular to their axial direction.

Figure 9G:
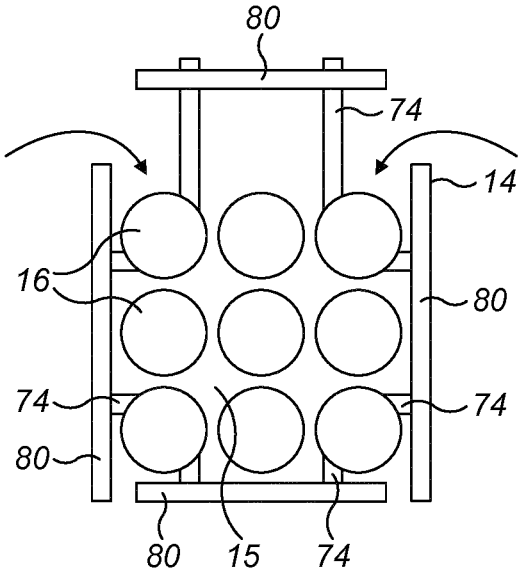
Figure 9H:
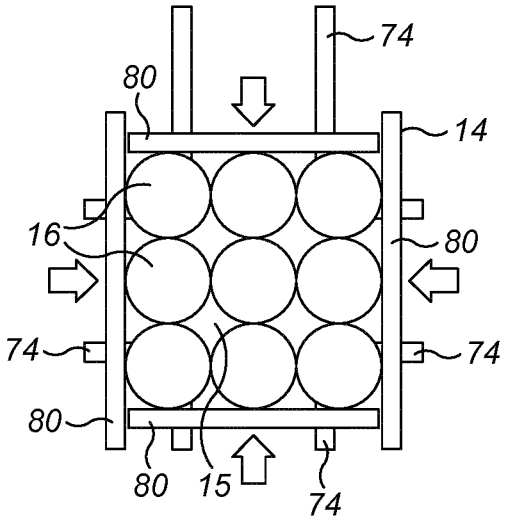

FIGS. 9*g* and 9*h* show a further arrangement similar to that described above with reference to FIGS. 9*e* and 9*f*. In this further arrangement, the uppermost wall 80 is mounted on a guide 74 aligned in a direction that is substantially orthogonal to the axial direction of the vapour generating rods 16 and that is dimensioned to displace the uppermost wall 80 further from the space 15 than the other walls 80 when the uppermost wall 80 is in the first position. This allows vapour generating rods 16 to be positioned in the space 15 defined by the walls 80, when the walls 80 are in the first position, in one or more sideways directions, for example as shown by the arrows in FIG. 9*g*.

Although exemplary embodiments have been described in the preceding paragraphs, it should be understood that various modifications may be made to those embodiments without departing from the scope of the appended claims. Thus, the breadth and scope of the claims should not be limited to the above-described exemplary embodiments.

Any combination of the above-described features in all possible variations thereof is encompassed by the present disclosure unless otherwise indicated herein or otherwise clearly contradicted by context.

Unless the context clearly requires otherwise, throughout the description and the claims, the words "comprise", "comprising", and the like, are to be construed in an inclusive as opposed to an exclusive or exhaustive sense; that is to say, in the sense of "including, but not limited to".

The invention claimed is:

1. A method of manufacturing a vapour generating product, the method comprising:
   (i) positioning non-liquid vapour generating material in a space defined by one or more walls configured to prevent movement of the vapour generating material by more than 2 mm in a direction perpendicular to an axial direction of the vapour generating material, the one or more walls extending substantially in the axial direction of the vapour generating material;
   (ii) aligning an axis of a rigid insertor with the axial direction of the vapour generating material; and
   (iii) inserting the rigid insertor into the vapour generating material from a first end of the vapour generating material.

2. The method according to claim 1, wherein step (i) comprises moving at least one of the walls to surround the vapour generating material.

3. The method according to claim 1, wherein the rigid insertor comprises an inductively heatable susceptor.

4. The method according to claim 1, wherein the vapour generating material is in the form of a cylindrical rod.

5. The method according to claim 1, wherein the non-liquid vapour generating material comprises a vapour generating rod and step (i) comprises forming a package comprising a plurality of the vapour generating rods.

6. The method according to claim 1, wherein step (ii) is performed by detecting the position of at least one of the rigid insertor or the vapour generating material.

7. The method according to claim 1, further comprising:
   releasing the vapour generating material from the space defined by the one or more walls.

8. The method according to claim 1, further comprising:
   supporting a second end of the vapour generating material during step (iii) to prevent movement of the vapour generating material.

9. The method according to claim 1, wherein step (iii) comprises the steps of:
   partially inserting the rigid insertor into the vapour generating material from the first end whilst holding the rigid insertor; and
   releasing the rigid insertor and pushing an end of the rigid insertor to fully insert the rigid insertor into the vapour generating material.

10. The method according to claim 1, wherein step (iii) comprises pushing and embedding the rigid insertor into the vapour generating material, and preferably during said embedding step a surface of the vapour generating material into which the rigid insertor is inserted is not pushed.

11. An apparatus for manufacturing a vapour generating product, the apparatus comprising:
   a surrounding unit configured to surround non-liquid vapour generating material;
   a holding unit configured to hold a rigid insertor; and
   a moving unit configured to move the non-liquid vapour generating material surrounded by the surrounding unit and the rigid insertor held by the holding unit relative to each other substantially in line with the axial direction of the vapour generating material to insert the rigid insertor into the vapour generating material from a first end of the vapour generating material;
   wherein the surrounding unit comprises one or more walls defining a space for the vapour generating material, the one or more walls being configured to prevent movement of the vapour generating material by more than 2 mm in a direction perpendicular to an axial direction of the vapour generating material.

12. The apparatus according to claim 11, wherein the holding unit includes a contact element to contact a side of the rigid insertor.

13. The apparatus according to claim 11, wherein the moving unit includes a pushing element to push an end of the rigid insertor.

14. The apparatus according to claim 13, wherein the pushing element includes a contact area having a shape which corresponds to the shape of an end of the rigid insertor or part of the shape of an end of the rigid insertor.

15. The apparatus according to claim 11, wherein the surrounding unit includes a movable wall.

16. The apparatus according to claim 15, wherein the movable wall is movable between a first position to allow positioning of the vapour generating material in the space and a second position to prevent release of the vapour generating material from the space.

17. The apparatus according to claim 11, wherein the surrounding unit includes a continuous transfer belt.

18. The apparatus according to claim 17, wherein the continuous transfer belt includes spaced contact elements configured to contact the vapour generating material and which form regions therebetween configured to accommodate the vapour generating material.

19. The apparatus according to claim 17, wherein the surrounding unit includes two continuous transfer belts, each transfer belt includes spaced contact elements configured to contact the vapour generating material and which form regions therebetween configured to accommodate the vapour generating material, each of the spaced contact elements has a summit and the summits of the spaced contact elements of each transfer belt are arranged to face each other.

20. The apparatus according to claim 17, wherein the holding unit is configured to move synchronously with the or each continuous transfer belt.

* * * * *